United States Patent [19]

Nakato et al.

[11] Patent Number: 4,806,163

[45] Date of Patent: Feb. 21, 1989

[54] MOLD ADDITIVES FOR USE IN CONTINUOUS CASTING

[75] Inventors: Hakaru Nakato; Tsutomu Nozaki; Yasuhiro Habu; Hiromu Oka; Tsunehiro Ueda; Takao Koshikawa, all of Chiba; Hideaki Kishimoto; Fumitaka Shimokawa, both of Kobe, all of Japan

[73] Assignees: Kawasaki Steel Corporation; Sakai Chemical Industriy Co., Ltd., both of Kobe, Japan

[21] Appl. No.: 122,498

[22] Filed: Nov. 5, 1987

Related U.S. Application Data

[63] Continuation of Ser. No. 865,910, May 13, 1986, abandoned, which is a continuation of Ser. No. 655,928, Sep. 28, 1984, abandoned.

[30] Foreign Application Priority Data

Sep. 30, 1983 [JP] Japan ..... 58-180704

[51] Int. Cl.[4] ..... B28B 7/36; C03C 3/112

[52] U.S. Cl. ..... 106/38.22; 106/38.27; 106/38.28; 75/96; 501/57; 164/123

[58] Field of Search ..... 106/38.22, 38.27, 38.28; 75/96; 501/57; 164/123

[56] References Cited

U.S. PATENT DOCUMENTS 3,899,324 8/1975 Corbett ..... 75/96
3,926,246 12/1975 Corbett et al. ..... 164/75
3,964,916 6/1976 Armistead et al. ..... 106/38.27
4,190,444 2/1980 Carini ..... 164/4
4,303,120 12/1981 Carini ..... 164/472
4,340,426 7/1982 Tabei et al. ..... 75/164

FOREIGN PATENT DOCUMENTS 0017713 10/1980 European Pat. Off. .

OTHER PUBLICATIONS

Abstract: Jap Patent 54-87,625 Jul. 12, 1979.
Abstract: Jap Patent 49-87,515 Aug. 21, 1974.

*Primary Examiner*—Theodore Morris
*Attorney, Agent, or Firm*—Balogh, Osann, Kramer, Dvorak, Genova & Traub

[57] ABSTRACT

A mold additive for use in continuous casting, which includes a base material having a chemical composition of CaO—BaO—$SiO_2$—F system, and contains 2-15% by weight in total of at least one carbonate of alkali and alkaline earth metals, 2-30% by weight in total of at least one fluoride of alkali and alkaline earth metals and 0.2-10% by weight of carbon, and, if necessary, 2-10% by weight in total of at least one oxide of Fe, Mn and Ni, and has a solidification temperature of not more than 900° C. and a viscosity at 1,300° C. of not more than 3 poises. The base material has a weight ratio of (CaO+BaO)/$SiO_2$ of 0.6-2.5 and contains not less than 2% by weight of BaO and 2-15% by weight of F.

3 Claims, 1 Drawing Sheet

*Effect of BaO content on the slag viscosity*

FIG. I
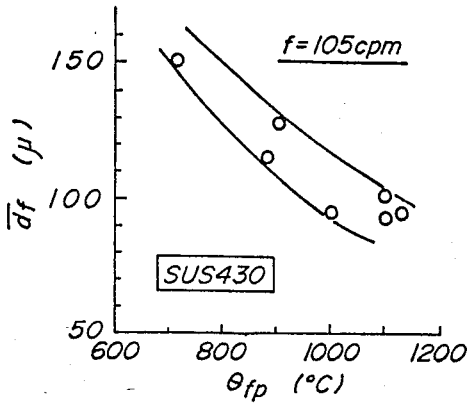
Relation betweem $\theta_{fp}$ and $\overline{d_f}$
FIG. II
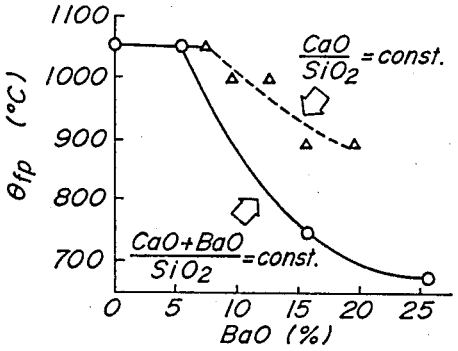
Effect of BaO content on the freezing point of slag melts
FIG. III
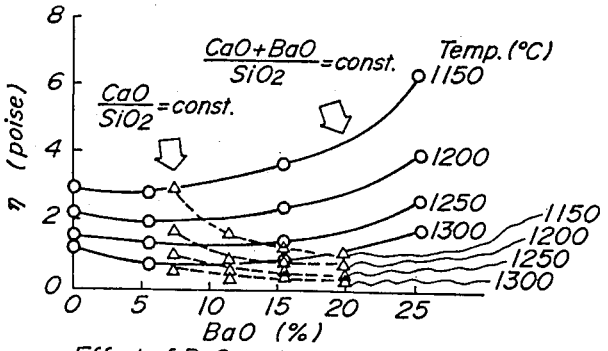
Effect of BaO content on the slag viscosity

MOLD ADDITIVES FOR USE IN CONTINUOUS CASTING

This application is a continuation of application Ser. No. 865,910, filed May 13, 1986, which is a continuation of U.S. Ser. No. 655,928 filed Sept. 28, 1984, both abandoned.

BACKGROUND OF THE INVENTION

1. Field of the Invention

This invention relates to a mold additive for use in a continuous casting (hereinafter referred to as mold powder), and more particularly to a mold powder useful for the application to steels of a type having a low hot strength. That is, the invention is concerned with a useful mold powder which can provide cast slabs having excellent surface properties without causing the casting troubles such as breakout and so on even under a high-speed casting or high cycle mold oscillation condition.

2. Description of the Prior Art

In the continuous casting using the same mold powder, when the casting is carried out at a higher speed or under a higher cycle mold oscillation, the consumption of the mold powder (i.e. amount of slag flowing from a meniscus in the mold into the gap between the mold and the solidification shell) is reduced to damage the lubrication inside the mold, which tends to cause the breakout or degrade the surface properties of the resulting cast slab. In order to increase the consumption of the mold powder, it is usually better to use a mold powder having low viscosity and crystallization temperature. Even if such a mold powder is used, however, the improvement on the surface properties of the cast slab is insufficient by experience though the consumption is increased, so that it is required to take another countermeasure.

For instance, in order to apply a cast slab of ferrite stainless steel (SUS 430) to a rolling without scarfing, it is indispensable to eliminate defects of the cast slab by lightening the formation of oscillation mark and preventing the occurrence and catch of slag inclusion in the oscillation mark portion and the formation of positive segregation. For this purpose, the casting is required to be carried out under a high cycle mold oscillation condition of not less than 150 cpm, preferably not less than 180 cpm.

In the ferritic stainless steel, however, the hot strength is low as compared with the other types of steel, so that the strength of solidification shell in the resulting cast slab is small and hence the degree of thrusting the solidification shell to the inner wall surface of the mold by static pressure of molten steel inside the cast slab becomes large. As a result, the gap between the mold and the solidification shell becomes smaller, which is apt to obstruct the flowing of the mold powder and hence cause a restraining breakout called as a sticking. Under the above circumstances, there is substantially no case that the steel of this type is stably cast at a cycle number of not less than 130 cpm up to now.

Therefore, a cast slab of SUS 430 (200×1,260 mm) was cast at a drawing speed of 0.9 m/min and a mold oscillation number of 210 cpm by using a mold powder shown as Comparative Example I in the following Table 4. In this case, the consumption of the mold powder is increased to 0.40 kg/t, which exceeds 0.35 kg/t being an empirically confirmed threshold consumption on the occurrence of breakout. However, the solidified steel cluster called as "Deckel" is formed on the surface of molten steel in the mold, which is considered to be caused by the heat of decomposition of excessive carbonate. Further, not only a large number of slag inclusions but also fine longitudinal cracks with a length of several tens millimeters are produced in the surface of the slab.

SUMMARY OF THE INVENTION

It is, therefore, an object of the invention to overcome the aforementioned problems produced in the continuous casting using the conventional mold powder under high-speed casting and high oscillation conditions. For this purpose, the invention provides a mold additive for use in the continuous casting, which is useful for obtaining cast slabs having substantially no defect even when steels of a type having a low hot strength are continuously cast under the above mentioned conditions.

The mold powder according to the invention roughly has the following two properties:

(1) The mold powder is adjusted to have a solidification temperature of not more than 900° C., preferably not more than 800° C. and a slag viscosity at 1,300° C. of not more than 3 poises, preferably not more than 2 poises; and (2) The wettability between molten steel and slag is good, the uniform flowability from meniscus portion of molten steel toward a widthwise directiion of slag is excellent, and the absorbency for inclusions and deoxidation products in steel is excellent. As a result, there is little change in the properties due to the absorption, particularly the viscosity value.

The term "solidification temperature of the mold powder" used herein means a temperature at which the measurement of viscosity becomes impossible due to the increase of measuring load based on the solidification when the viscosity is measured by gradually reducing the temperature from a melting state.

The inventors have made various studies on the properties of the mold powder and found out the following facts. For instance, in case of steels of a type having a low hot strength, such as ferritic stainless steel or the like, when the tip of molten steel is solidified and shrunk at its meniscus portion by a cooled mold, a gap is produced between the mold and the solidification shell, but the solidification shell is expanded outward by the static pressure of unsolidified molten metal and pushed to the mold because the strength of the solidification shell is weak, so that there is a trend of causing ununiform flowing in the widthwise direction or obstruction of slag flowing due to the narrowing of the gap between the mold and the solidification shell.

Now, the inventors have investigated the lubricating state of slag film, which is fundamental for solving the above problem. As a result, it has been found that the slag film is solidified at the side facing the cooled mold but maintains the fluid state at the side facing the solidification shell to develop the lubrication function, and the ratio of solidified portion to fluid portion in the slag film and the whole thickness of the film are largely dependent on the solidification temperature of the mold powder. The inventors have made further studies based on the above knowledge and found that it is very effective to reduce the solidification temperature of the mold powder in order to enhance the cooling efficiency of the meniscus portion to increase the strength of the solidification shell without strengthening the cooling of the mold and to promote the lubrication function of the slag film. Namely, the reduction of the soldification temperature of the mold powder decreases the thickness of the solidified portion in the slag film and increases the quantity of heat deprived from molten steel with the mold to more proceed the cooling of the meniscus portion, whereby the strength of the solidification shell in the meniscus portion is increased.

As a result of further investigations, it has been found that the flowability of the mold powder toward the widthwise direction is further improved by limiting the solidification temperature of the mold powder to not more than 900° C., preferably not more than 800° C. This is considered to be due to the fact that when the solidification temperature of the mold powder is reduced to the above temperature range, the solidified portion of the slag film disappears practically.

Next, the inventors have made various experiments on the continuous casting for the ferritic stainless steel at a high frequency oscillation using the mold powder having the aforementioned low solidification temperature, from which it has been found that when the mold powder having the low solidification temperature is adjusted to be low in the viscosity, the amount of the mold powder flowing is sufficiently assured even under the high cycle condition. Concretely, it has been found that when the viscosity of the mold powder is set to not more than 3 poises, preferably not more than 2 poises at 150–200 cpm and 1,300° C. and to not more than 2 poises, preferably not more than 1 poise at more than 200 cpm and 1,300° C., the continuous casting can advantageously be carried out under a high cycle mold oscillation condition without producing the slag inclusion and fine longitudinal crack in the surface of the cast slab as previously mentioned. Moreover, it has been confirmed that the uniform flowability of the mold powder is more promoted by enhancing the wettability between molten mold powder and molten steel to thereby reduce the occurrence of longitudinal crack. The effect of reducing the longitudinal crack by the enhancement of wettability has also been recognized even in the high-speed casting of slabs for use in plates.

According to the invention, there is the provision of a mold additive for use in a continuous casting, which comprises a base material having a chemical composition of CaO—BaO—$SiO_2$—F system, the base material being vitrified by a preliminary melting and having a weight ratio of $(CaO+BaO)/SiO_2$ of 0.6~2.5 and containing not less than 2% by weight of BaO and 2–15% by weight of F, and contains 2–15% by weight in total of at least one carbonate of alkali and alkaline earth metals, 2–30% by weight in total of at least one fluoride of alkali and alkaline earth metals and 0.2–10% by weight of carbon based on said base material, respectively. Further, there is the provision of a mold additive for use in a continuous casting, which includes a base material having a chemical composition of CaO—BaO—$SiO_2$—F system, the base material being vitrified by a preliminary melting and having a weight ratio of $(CaO+BaO)/SiO_2$ of 0.6~2.5 and containing not less than 2% by weight of BaO and 2–15% by weight of F, and contains 2–15% by weight in total of at least one carbonate of alkali and alkaline earth metals, 2–30% by weight in total of at least one fluoride of alkali and alkaline earth metals, 0.2–10% by weight of carbon and 2–10% by weight in total of at least one oxide of Fe, Mn and Ni based on the base material, respectively.

BRIEF DESCRIPTION OF THE DRAWINGS

In order to increase the flowing amount of slag from the meniscus it is necessary to lower θfp (solidification temperature of slag) as shown in FIG. 1 in addition to the lowering of viscosity. It is considered that, as θfp lowers, the flowing slit becomes thicker and hence the flowing amount of slag increases. In order to lower θfp the concentrations of $Na_2O$ and F in the powder are made high, or $B_2O_3$, BaO MgO or the like is added to the powder. The influence of BaO on solidification temperature and viscosity was examined by varying the amount of BaO added to a powder having $CaO/SiO_2=1.26$, NaF=19% and $Al_2O_3=6\%$. As shown in FIG. II, θfp is lowered when the concentration of BaO is not less than 5%, and particularly θfp becomes considerably lower than the concentration of BaO is increased at a constant value of $(CaO+BaO/SiO_2$ as compared with the case of increasing BaO concentration at a constant value of $CaO/SiO_2$. On the other hand, as shown in FIG. III, the viscosity tends to become higher at BaO>15% when the BaO concentration is increased at a constant value of $(CaO+BaO)/SiO_2$, while when the BaO concentration is increased at a constant value of $CaO/SiO_2$, the viscosity becomes lower at BaO<15%.

DETAILED DESCRIPTION OF THE INVENTION

As an effective means for reducing the solidification temperature of the mold powder and performing the good lubrication inside mold, it has been confirmed that it is better to use as a base material a vitrified (amorphous) material obtained by adding BaO and further fluorine (F) to CaO—$SiO_2$ system, which is a main starting material in the usual mold powder for use in the continuous casting, and preliminarily melting them (hereinafter referred to as a preliminarily melted base material). As CaO in the CaO—$SiO_2$ system is gradually replaced with BaO, the solification temperature of the mold powder reduces and the vitrification tendency increases. However, it is difficult to form the powdery base material by merely replacing CaO with BaO. Now, the inventors have contrived a way for adding BaO to the CaO—$SiO_2$ system of the powdery form. A commercially available substance for providing BaO is usually barium carbonate. When such a carbonate is used as it is, it is decomposed by the heat of molten steel to form BaO, but it can not be ignored that the melting of the mold powder and the heat retaining property of molten steel surface in the mold are obstructed by endothermic reaction in the above decomposition. If BaO is supplementally added for regulating the properties of the mold powder as mentioned later, the carbonate may be used, but when a large amount of BaO is used as a part of the powdery base material as in the invention, it causes the aforementioned problem.

The inventors have made studies from a viewpoint that the above problem may be solved by preliminarily melting BaO used as a part of the base material, and found that when such a base material is preliminarily melted and made into a vitrified form, not only the melting of the mold powder is smooth, but also the effect of reducing the solidification temperature is much larger as compared with the case of adding BaO in form of carbonate. This is guessed to be due to the fact that in case of adding carbonate, unmelted BaO remains in the melt of the mold powder and forms a crystal nucleus in the solification because the thermal decomposition temperature of barium carbonate is 1,380° C. and is fairly higher than the melting temperature of the mold powder for use in the continuous casting (usually not more than 1,200° C.). Thus, it has been confirmed that the incorporation of BaO into the preliminarily melted powdery base material is very effective for the reduction of the solidification temperature.

Further, the mold powder for use in the continuous casting using the preliminarily melted base material inclusive of BaO has a large dissolving power against oxides such as $Al_2O_3$, $Cr_2O_3$ and the like, which bring about the slag inclusion, and is excellent in the vitrification even after the dissolution.

The mold powder according to the invention will be described below with respect to the chemical composition.

In the chemical composition of the base material, the weight ratio of $(CaO+BaO)/SiO_2$ or a so-called basicity is limited to a range of 0.6–2.5. When the basicity is less than 0.6, the viscosity value is too high, while when the basicity exceeds 2.5, the solidification temperature of the mold powder rises undesirably. Particularly, when $(CaO+BaO)/SiO_2$ in the preliminarily melted base material exceeds 2.5, the uniform melting of the mold powder is damaged in use. When the content of BaO is less than 2% by weight, the effect of reducing the solidification temperature is hardly expected. In the base material, F is added in an amount of 2–15% by weight for promoting the preliminarily melting efficiency of $CaO—BaO—SiO_2$ system and reducing the vscosity and softening point of the mold powder. When the amount of F is less than 2%, the effect for the preliminary melting is insufficient, while when the amount of F exceeds 15%, the crystal is apt to be crystallized in the solidification of the mold powder and it is difficult to advantageously obtain the vitrified base material.

The operative compounds used to add flourine in formulating the base material are calcium flouride, sodium flouride, cryolite and the like.

When the ferritic stainless steel is continuously cast under a high cycle condition using a mold powder obtained by adding carbonates of alkali and alkaline earth metals, fluorides of alkali and alkaline earth metals, carbon and the like as a flux component to the preliminarily melted and vitrified base material, it has been found that the uniform flowability of slag in widthwise direction can be obtained very satisfactorily and consequently the longitudinal crack on the surface of the resulting case slab decreases remarkably as compared with the case of using the conventional mold powder and also the slag inclusion resulted from the oxides such as $Al_2O_3$ and $Cr_2O_3$ decreases.

In addition, when oxides of Fe, Mn and Ni having a good wettability to molten steel are added to the above mold powder, it has been confirmed that the uniform flowability of slag from the meniscus portion is further improved to more decrease the above defects. In this case, the oxides of Fe, Mn and Ni may be added alone or in admixture in an amount in total of 2–10% by weight. When the amount of such oxides added is less than 2%, the effect of improving the slag flowability is insufficient, while when it exceeds 10%, the slag flowability is degraded.

According to the invention, the carbonates of alkali and alkaline earth metals, the fluorides of alkali and alkaline earth metals, carbon and the like are supplementally added to regulate the properties of the mold powder in accordance with the casting conditions. As to the addition of the carbonate, when the total amount is less than 2% by weight, there is no addition effect, while when it exceeds 15% by weight, the influence of endothermic reaction largely appears in the thermal decomposition to obstruct the smooth melting of the mold powder. As to the addition of the fluoride, when the total amount is less than 2% by weight, there is no addition effect, while when it exceeds 30% by weight, the tendency of vitrifying the mold powder is considerably obstructed. Moreover, it has been confirmed that the mold powder comprising the vitrified base material and auxiliary additives for the regulation of properties besides the sole vitrified base material has also excellent absorbency and dissolving power against hardly insoluble deoxidized inclusions such as $Al_2O_3$, $Cr_2O_3$, $TiO_2$ and the like and the change of properties due to absorption is little. Furthermore, carbon is added as a powder in an amount of 0.2–10% by weight. When the amount of carbon is less than 0.2%, there is no addition effect, while when it exceeds 10%, the melting speed of the mold powder is largely restrained. The amount of carbon added is preferably within a range of 0.5 to 5% by weight.

In the base material of $CaO—BaO—SiO_2—F$ system, the preliminarily melting components are desirable to have a high purity, but even when each of the oxides such as $Al_2O_3$, MgO, $Fe_2O_3$ and the like is existent in an amount of less than 5% by weight as an impurity after the preliminary melting, the effect of the invention is not damaged. Moreover, the vitrified base material of $CaO—BaO—SiO_2—F$ system is pulverized to not more than 100 mesh, mixed with the other additives, and then powdered or granulated to provide mold powder for use in the continuous casting.

EXAMPLE

A preliminarily melted base material having a chemical composition shown in the following Table 1 was mixed with fluxes and carbonaceous substance to prepare a mold powder for use in a continuous casting as shown in the following Tables 2 and 3, which was used in an empiric test for continuous casting. In the following Table 5 are shown empirical test results when continuously casting SUS 430. Among these results, Run Nos. 1, 3 and 4 show the case of using mold powders as Comparative Examples in the following Table 4, which improve the surface properties of the cast slab but are high in the frequency of occurrence of breakout during the use under a high cycle condition as compared with Run No. 2 showing the casting under a low cycle mold oscillation condition.

On the other hand, Run Nos. 5–9 are examples using the mold powder according to the invention, and show a remarkable effect of improving the surface properties of the cast slab and a considerable reduction of the frequency of occurrence of breakout even in the continuous casting under a high cycle condition.

The cast slabs of SUS 430, which are cast under the high cycle mold oscillation condition using the mold powder according to the invention, are made possible to be subjected to a rolling without scarfing, resulting in the reduction of cost and the significant energy-saving.

TABLE 1

| Composition | | $SiO_2$ | CaO | $Al_2O_3$ | $Na_2O$ | BaO | F | $\frac{CaO}{SiO_2}$ | $\frac{CaO + BaO}{SiO_2}$ |
|---|---|---|---|---|---|---|---|---|---|
| Chemical composition of preliminarily melted base material | | | | | | | | | |
| A | Base material containing BaO | 53 | 26 | 2.6 | 6 | 9 | 2.4 | 0.49 | 0.66 |
| B | | 47 | 31 | 2.7 | 4 | 12 | 2.4 | 0.66 | 0.91 |
| C | | 38 | 36 | 3.5 | — | 15 | 7.0 | 0.94 | 1.34 |
| D | | 30 | 40 | 4.0 | — | 20 | 5.0 | 1.33 | 2.00 |
| E | (Comparative base material containing no BaO) | 49 | 44 | 2.5 | — | — | 2.5 | 0.90 | — |

TABLE 2

| Compounding recipe (wt %) | Mold powder according to the invention No. I | II | III | IV | V | VI | VII | VIII | IX | X | Remarks |
|---|---|---|---|---|---|---|---|---|---|---|---|
| Preliminarily melted base material A | 69 | | 72 | | | | | | | | |
| Preliminarily melted base material B | | 75 | | | | | 66 | 70 | | | |
| Preliminarily melted base material C | | | | 79.5 | 78.5 | | | | 73.5 | 71.5 | |
| Preliminarily melted base material D | | | | | | 77.5 | | | | | |
| Iron oxide | | | | | | | 2 | 2 | 2 | | oxides of Fe, Ni, Mn |
| Nickel oxide | | | | | | | | 3 | | 3 | |
| Manganese oxide | | | | | | | 7 | | 3 | 4 | |
| Barium carbonate | 7 | | | | 2 | 2 | | | 2 | 2 | |
| Sodium carbonate | | 2 | 4 | 10 | 8 | 5 | 2 | 2 | 8 | 8 | Carbonates |
| Magnesium carbonate | | 2 | | 2 | 2 | 2 | 2 | 2 | 2 | 2 | |
| Fluorite | 7 | | 7 | | | | | | | | Fluorides |
| Sodium fluoride | 14.5 | 18.5 | 14.5 | 5 | 6 | 10 | 18.5 | 18.5 | 6 | 6 | |
| Carbon A | 1.5 | 1.5 | 1.5 | 1.5 | 1.5 | 1.5 | 1.5 | 1.5 | 1.5 | 1.5 | Carbon powder |
| Carbon B | 1.0 | 1.0 | 1.0 | 2.0 | 2.0 | 2.0 | 1.0 | 1.0 | 2.0 | 2.0 | |

TABLE 3

| Item | Composition and properties of mold powder according to the invention No. I | II | III | IV | V | VI | VII | VIII | IX | X |
|---|---|---|---|---|---|---|---|---|---|---|
| Composition (wt %) | | | | | | | | | | |
| T.C. | 2.9 | 2.9 | 2.9 | 4.7 | 4.6 | 4.3 | 2.9 | 2.9 | 4.6 | 4.6 |
| $SiO_2$ | 36.6 | 35.3 | 38.2 | 30.2 | 29.8 | 23.3 | 31.0 | 32.9 | 27.9 | 27.2 |
| CaO | 22.7 | 23.3 | 23.5 | 28.6 | 28.3 | 31.0 | 20.5 | 21.7 | 26.5 | 25.7 |
| $Al_2O_3$ | 1.8 | 2.0 | 1.9 | 2.8 | 2.7 | 3.1 | 1.8 | 1.9 | 2.6 | 2.5 |
| $Na_2O$ | 14.5 | 17.2 | 16.4 | 7.9 | 7.7 | 9.4 | 16.7 | 16.9 | 7.7 | 7.7 |
| BaO | 11.5 | 9.0 | 6.5 | 11.9 | 13.3 | 17.0 | 7.9 | 8.4 | 12.5 | 12.3 |
| F | 11.7 | 9.9 | 11.4 | 7.8 | 8.1 | 8.3 | 9.7 | 9.8 | 7.7 | 7.6 |
| MgO | — | 0.9 | — | 0.9 | 0.9 | 0.9 | 0.9 | 0.9 | 0.9 | 0.9 |
| FeO | — | — | — | — | — | — | 2.0 | 2.0 | 2.0 | — |
| NiO | — | — | — | — | — | — | — | 3.0 | — | 3.0 |
| MnO | — | — | — | — | — | — | 7.0 | — | 3.0 | 4.0 |
| $CaO/SiO_2$ | 0.62 | 0.66 | 0.62 | 0.95 | 0.95 | 1.33 | 0.66 | 0.66 | 0.95 | 0.95 |
| $CaO + BaO/SiO_2$ | 0.93 | 0.93 | 0.79 | 1.34 | 1.40 | 2.06 | 0.92 | 0.91 | 1.40 | 1.40 |
| Viscosity (poise) | 2.5 | 1.7 | 2.2 | 1.0 | 0.9 | 0.4 | 1.0 | 1.3 | 1.3 | 1.2 |
| Solidification point (°C.) | 720 | 760 | 680 | 800 | 780 | 870 | 730 | 750 | 880 | 850 |

TABLE 4

| Mold powder for Comparative Example | I | II | III |
|---|---|---|---|
| Compounding recipe (wt %) | | | |
| Preliminarily melted base material A | 61 | 65 | |
| Preliminarily melted base material E | | | 63 |
| Barium carbonate | 12 | 15 | 12 |
| Sodium carbonate | 5 | 5 | 2 |
| Magnesium carbonate | | | 2 |
| Fluorite | 7 | | |
| Sodium fluoride | 12.5 | 12.5 | 18.5 |
| Carbon A | 1.5 | 1.5 | 1.5 |
| Carbon B | 1.0 | 1.0 | 1.0 |
| Composition (wt %) | | | |

TABLE 4-continued

| Mold powder for Comparative Example | I | II | III |
|---|---|---|---|
| T.C. | 3.6 | 3.6 | 3.5 |
| $SiO_2$ | 32.3 | 34.5 | 30.8 |
| CaO | 20.7 | 16.9 | 27.7 |
| $Al_2O_3$ | 1.6 | 1.7 | 1.6 |
| $Na_2O$ | 14.8 | 15.0 | 14.1 |
| BaO | 14.6 | 17.3 | 9.1 |
| F | 10.3 | 7.1 | 9.7 |
| MgO | | | 0.9 |
| $CaO/SiO_2$ | 0.64 | 0.49 | 0.90 |
| $CaO + BaO/SiO_2$ | 1.09 | 0.99 | 1.19 |
| Viscosity (poise) | 2.4 | 2.7 | 1.2 |
| Solidification point (°C.) | 880 | 850 | 1,030 |

TABLE 5

| Run No. | Kind of mold powder | Size of slab (mm) | Drawing speed (m/min) | Number of mold oscillation (cpm) | Index of powder consumption *1 | Index of slag inclusion *1 | Index of surface cracking *1 | Frequency of occurrence of breakout *2 | Type of steel |
|---|---|---|---|---|---|---|---|---|---|
| 1 | Comparative Example I | 200 × 1,260 | 0.9 | 210 | 1.0 | 1.0 | 1.0 | 2.0 | SUS 430 |
| 2 | Comparative Example I | " | 0.9 | 110 | 1.4 | 2.5 | 2.0 | 1.0 | " |
| 3 | Comparative Example II | 200 × 1,240 | 0.9 | 180 | 1.2 | 0.8 | 1.0 | 1.5 | " |
| 4 | Comparative Example III | 200 × 1,260 | 0.9 | 200 | 0.8 | 0.9 | 1.2 | 3.0 | " |
| 5 | Example I | 200 × 1,240 | 0.9 | 200 | 1.4 | 0.1 | 0.1 | <0.1 | " |
| 6 | Example II | " | 0.9 | 250 | 1.3 | 0.2 | 0.2 | <0.1 | " |
| 7 | Example III | " | 0.9 | 300 | 1.3 | 0.2 | 0.1 | <0.1 | " |
| 8 | Example IV | " | 0.9 | 250 | 1.4 | 0.1 | 0.1 | <0.1 | " |
| 9 | Example V | 200 × 1,060 | 0.9 | 300 | 1.2 | 0.1 | 0.1 | <0.1 | " |
| 10 | Example VI | " | 0.9 | 300 | 1.7 | 0.1 | 0.3 | <0.1 | " |
| 11 | Example VII | " | 0.9 | 300 | 1.3 | 0.1 | 0.1 | <0.1 | " |
| 12 | Example VIII | " | 0.9 | 300 | 1.3 | 0.1 | 0.1 | <0.1 | " |
| 13 | Example IX | " | 0.9 | 250 | 1.5 | 0.1 | 0.1 | <0.1 | " |
| 14 | Example X | " | 0.9 | 250 | 1.5 | 0.1 | 0.1 | <0.1 | " |

Note
*1: The index value is represented on a basis that Comparative Example I of Run No. 1 is 1.0.
*2: The index value is represented on a basis that Comparative Example I of Run No. 2 is 1.0.

As mentioned above, when using the mold powder according to the invention, even if steels of a type having a low hot strength are subjected to a continuous casting at a high speed under a high cycle mold oscillation condition, it makes possible to obtaiN cast slabs having a considerably small casting defect and excellent surface properties. Therefore, the resulting cast slab can directly be subjected to a rolling without scarfing, which results in the laborand energy-saving.

What is claimed is:

1. A mold additive for use in a continuous casting under a high cycle mold oscillation, which comprises a base material having a chemical composition of CaO—BaO—$SiO_2$—F system, said base material being vitrified by a preliminary melting and having a weight ratio of $(CaO+BaO)/SiO_2$ of 0.6–2.5 and containing not less than 2% by weight of BaO, 2–15% by weight of F and not more than 10% of $Al_2O_3$; said mold additive consisting mainly of 20–40% by weight of $SiO_2$, 15–35% by weight of CaO and 5–20% by weight of BaO, and containing 2–15% by weight in total of at least one carbonate of alkali and alkaline earth metals, 2–30% by weight in total of at least one fluoride of alkali and alkaline earth metals, 2–10% by weight in total of at least one oxide of Fe, Mn, and Ni, and 0.5–5% by weight of carbon based on said base material, respectively, and having a solidification temperature of not more than 900° C. and a viscosity at 1300° C. of not more than 2 poises.

2. A mold additive according to claim 1, wherein said solidification temperature is not more than 800° C. and said viscosity at 1,300° C. is not more than 2 poises.

3. A mold additive according to claim 1, wherein said amount of carbon is within a range of 0.5–5% by weight.

* * * * *